United States Patent [19]

Kimura et al.

[11] Patent Number: 4,867,932

[45] Date of Patent: Sep. 19, 1989

[54] PROCESS OF MAKING A CASTING NOZZLE

[75] Inventors: Haruyoshi Kimura; Yoshitaka Hiraiwa; Hiroyuki Shiokawa; Hiroshi Nagata; Yukio Inoue, all of Fukuoka, Japan

[73] Assignee: Kurosaki Refractories Co., Ltd., Fukuoka, Japan

[21] Appl. No.: 89,294

[22] Filed: Aug. 25, 1987

Related U.S. Application Data

[62] Division of Ser. No. 897,885, Aug. 19, 1986, Pat. No. 4,779,775.

[30] Foreign Application Priority Data

Aug. 29, 1985 [JP] Japan ..... 60-191351

[51] Int. Cl.[4] ..... B22D 41/08; B29C 43/02; B29C 67/20

[52] U.S. Cl. ..... 264/29.1; 264/43; 264/44; 264/59; 264/60; 264/155; 264/256; 264/317; 264/DIG. 44

[58] Field of Search ..... 264/29.1, 43, 44, 59, 264/60, 155, 256, 332, 221, 317, DIG. 44; 222/603

[56] References Cited

U.S. PATENT DOCUMENTS

| | | | |
|---|---|---|---|
| 3,533,753 | 10/1970 | Berger | 264/44 X |
| 3,758,652 | 9/1973 | Jebens | 264/43 |
| 4,225,544 | 9/1980 | Dantzig et al. | 264/43 |
| 4,583,721 | 4/1986 | Arakawa et al. | 222/603 X |
| 4,588,112 | 5/1986 | Kondo | 222/603 |
| 4,632,283 | 12/1986 | Arakawa et al. | 222/603 X |
| 4,650,619 | 3/1987 | Watanabe | 264/44 X |
| 4,664,858 | 5/1987 | Kido et al. | 264/44 |
| 4,682,718 | 7/1987 | Watanabe et al. | 264/44 X |
| 4,687,607 | 8/1987 | Shigeta et al. | 264/44 X |

FOREIGN PATENT DOCUMENTS

| | | | |
|---|---|---|---|
| 49-322 | 1/1974 | Japan | 264/59 |
| 56-102357 | 8/1981 | Japan . | |

*Primary Examiner*—Jeffery Thurlow
*Assistant Examiner*—Leo B. Tentoni
*Attorney, Agent, or Firm*—Jordan and Hamburg

[57] ABSTRACT

A process is disclosed for making a casting nozzle wherein gas can be blown out through the outlet of the nozzle to prevent the sticking of nonmetallic impurities to the nozzle during use. Reticulate organic filaments in the form, e.g., of a net are applied around a preformed inner cylindrical refractory body having a pouring hole therein. An outer cylinder body is then formed around the inner cylinder body including the organic filaments. The entire body is then fired, whereby the organic filaments carbonize and evaporate, leaving a network of gas-permeable reticulate holes in the body. An outlet is drilled or cut in the fired body through the gas-permeable holes to the pouring holes. Accordingly, when the nozzle is in use, a blowing gas can be provided through the reticulate holes to the nozzle outlet to prevent the sticking of nonmetallic impurities.

17 Claims, 5 Drawing Sheets

PROCESS OF MAKING A CASTING NOZZLE

This is a division of application Ser. No. 897,885, filed Aug. 19, 1986,now U.S. Pat. No. 4,779,775, issued Oct. 25, 1988.

BACKGROUND OF THE INVENTION

1. Field of the Invention

The present invention relates to a casting nozzle and its producing method, such as an immersion nozzle or shroud having blowout holes to prevent clogging with nonmetallic impurities and also with a method for producing the same.

2. Description of the Prior Art

In the continuous casting of molten metal (like molten steel), an immersion casting nozzle designed to blow an inert gas, during casting, into the molten metal through a cylindrical part of the nozzle has come into general use recently. The blowing of an inert gas is intended to prevent clogging of the nozzle with nonmetallic impurities such as alumina sticking to the wall of the pouring hole.

An example of the immersion nozzle is disclosed in Japanese Patent Laid-open No. 56-102357. It has such a structure that a hollow chamber having an annular section is formed in the axial direction of the nozzle. A gas is blown out through this hollow chamber into the molten metal flowing through the nozzle. The gas flow prevents nonmetallic impurities such as alumina from sticking to the inside wall of the immersion nozzle.

However, in this type of nozzle, the effect of gas blowing for preventing the sticking is not satisfactory. Sticking of nonmetallic impurities to the outlet of the nozzle makes the casting nozzle of limited repeated use for continuous casting.

SUMMARY OF THE INVENTION

It is an object of the present invention to provide a casting nozzle designed such that the sticking of nonmetallic impurities to the outlet of the nozzle is prevented by blowing out a gas.

It is another object of the present invention to provide a method for producing in a simple manner a casting nozzle having a blowing structure for blowing out a gas.

The casting nozzle of this invention comprises a nozzle proper, an annular hollow chamber for gas blowing formed in the axial direction of the nozzle proper, and annularly arranged reticulate small holes for gas blowing communicating with the annular hollow chamber, the small holes opening at the outlet of the nozzle.

According to the method of this invention, the reticulate small holes are formed when organic filaments wound round a part of the inside wall of the nozzle proper carbonize, volatilize, or shrink upon heating. Reticulated small holes are communicating holes in the shape of a netting which may be prepared by partially winding a netting of an organic material on an inner wall portion of the casting nozzle and shrinking the wound netting by carbonization or volatilization.

DESCRIPTION OF THE PREFERRED EMBODIMENTS

Figure 1:
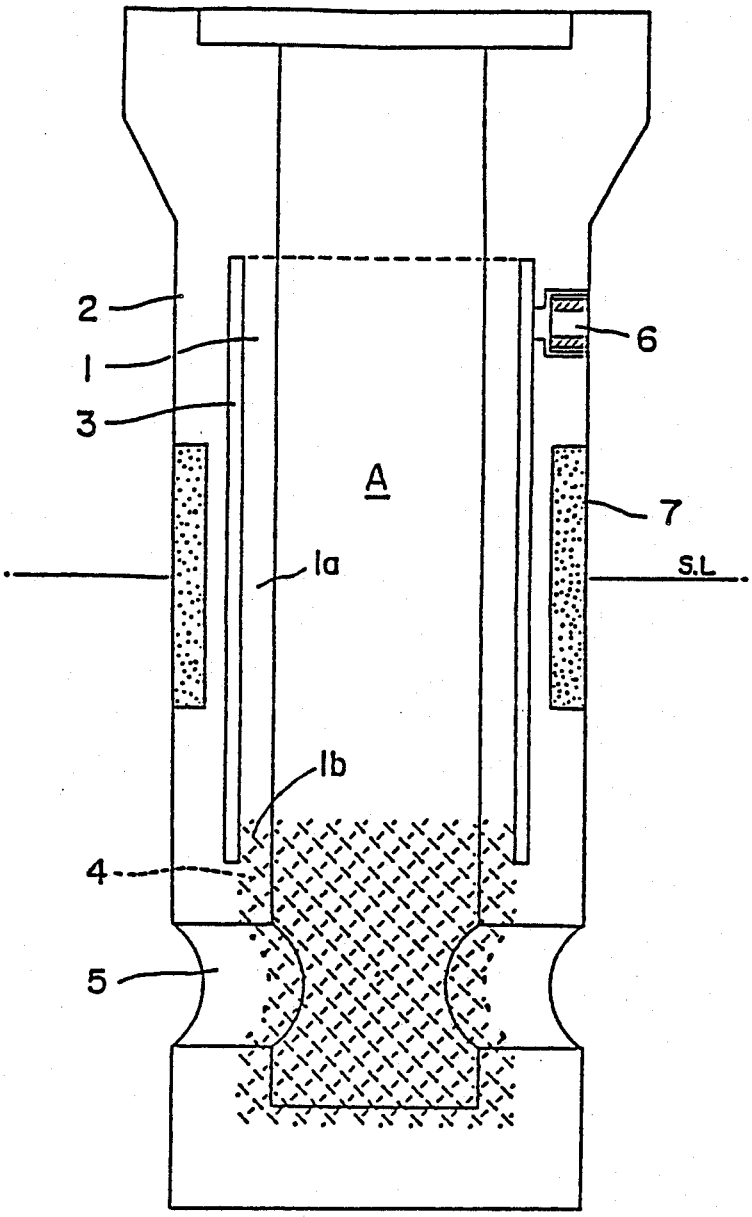
FIG. 1 is a sectional view of an embodiment of the casting nozzle of this invention.

The casting nozzle of this invention has the structure as shown in FIG. 1. The casting nozzle has a hollow chamber (3) between an inner wall (1) forming a pouring hole (A) and outer wall (2) forming the nozzle proper. The upper part of the inner wall (1) is made of a gas-permeable material (1*a*) and the lower part of the inner wall (1) is made of a gas-impermeable material (1*b*). In the periphery of the part made of a gas-impermeable material (1*b*) are formed reticulate small holes (4) which communicate with the hollow chamber (3). The reticulate small holes (4) open at outlet (5) formed at the lower part of the casting nozzle. The outer wall (2) has a hole which communicates with hollow chamber (3), and socket (6) is fitted into the hole to facilitate the introduction of blowing gas. To prevent the casting nozzle from being corroded by slag, protective layer (7) is formed on the outer wall (2) at the position corresponding to the slag level (SL).

When the casting nozzle is in use, an inert gas is blown into the nozzle. A portion of the inert gas passes through the gas permeable material (1*a*) constituting the inner wall of the hollow chamber (3) and enters the pouring hole (A), preventing nonmetallic impurities such as alumina from sticking to the inside of the pouring hole (A). Furthermore, the other portion of the inert gas blowing into the nozzle passes through the reticulate small holes (4) that communicate with the hollow chamber and then blows out from the openings of the small holes distributed on the periphery of the inside of the outlet (5), thus preventing nonmetallic impurities from sticking to the outlet (5).

The reticulate small holes distributed on the periphery of the inside of the outlet (5) permit the gas to blow out in the form of fine bubbles from the periphery of the inside of the outlet (5). The blown gas flows and washes the inside or the outlet along with the molten metal. In this manner, the outlet (5) is protected from the sticking of nonmetallic impurities thereto. The outlet (5) is formed so that the reticulate small holes open on the inside thereof. The reticulate small holes may be arranged in multiple layers so that the openings of the reticulate small holes are arranged in multiple rows on the inside of the outlet (5). These arrangements permit the gas to be blown out uniformly in the form of fine bubbles, and this effectively prevents the clogging of the outlet (5).

In the meantime, where it is possible to avoid the sticking to the inside of the pouring hole (A) by other methods such as the blowing of a gas from the upper nozzle, it is also possible to prevent the sticking of alumina, etc., to the wall of the outlet only by providing the small holes for gas blowing which are arranged in annular section and connected to one another in reticulate form. In this case, the small holes for gas blowing may be formed on either a gas permeable material or a gas impermeable material forming the nozzle proper. Alternatively, it is also possible to attach a porous body to the end of the reticulate small hole at the wall of the outlet.

EXAMPLE 1

An immersion nozzle of this invention was produced according to the steps as shown in FIG. 2.

Figure 2A:
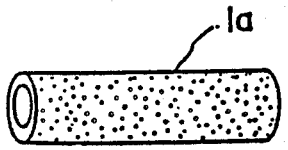
FIGS. 2*a*–2*f*, 3*a*–3*e*, 4*a*–4*c* and 5*a*–5*b* are schematics showing the process of producing casting nozzles of different types of this invention.
Figure 2B:
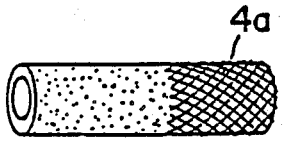

At first, a preformed, cylindrical gas permeable body (1*a*) was prepared (FIG. 2*a*). The outer surface covering half a length of the cylindrical gas permeable body (1*a*) was wrapped with a reticulate material (4*a*) having an opening of 5 mm made of organic filaments 0.2 mm in diameter (FIG. 2*b*).

Figure 2C:
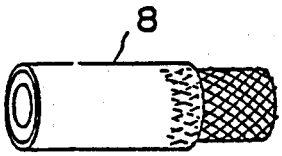
Figure 2D:
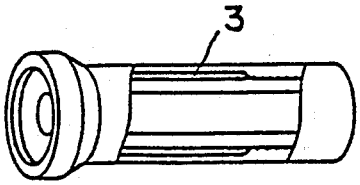
Figure 2E:
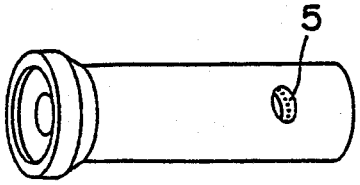
Figure 2F:
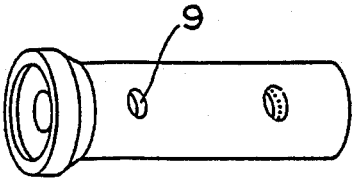

The remainder of the outer surface of the cylindrical gas permeable body (1*a*) was coated with wax (8) to a predetermined thickness, with the wax and the net partly overlapping with each other (FIG. 2*c*). The cylindrical gas permeable body (1*a*) was fixed onto the core metal that forms the pouring hole, with the reticulate material (4*a*) upward. A rubber mold to form the nozzle proper was slipped on. The spaces between the rubber mold and the gas permeable body (1*a*) and between the rubber mold and the core were filled with an alumina-graphite body to form the nozzle proper and a zirconia-graphite body to form the protective layer. With the mold sealed by a lid, pressure molding was performed by means of a rubber press to form the nozzle proper. The molded nozzle proper was fired in a reducing atmosphere to yield the nozzle stock (FIG. 2*d*). The periphery and overall length of the nozzle stock were finished to desired dimensions, and the outlets (5) were made by drilling at the part where the reticulate small holes had been formed (FIG. 2*e*). The hole (9) was made which communicates with the hollow chamber (3) formed by the application of wax (FIG. 2*f*). Into the hole (9) was fitted the socket (6) through which a gas is blown in. Thus there was obtained the immersion nozzle.

The immersion nozzle was evaluated by the actual operation of continuous steel casting. It permitted the casting of 675 tons of steel without any trouble. On checking after use, it was found that the amount of impurities sticking to the outlet of the nozzle was about one-third that in the case of a conventional immersion nozzle. For a comparison, a conventional immersion nozzle became unusable after the casting of 540 tons of steel due to the clogging of the outlet.

EXAMPLE 2

An immersion nozzle of this invention was produced according to the steps as shown in FIG. 3.

Figure 3A:
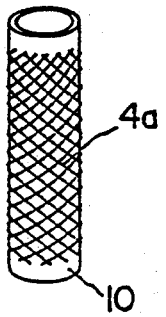
Figure 3B:
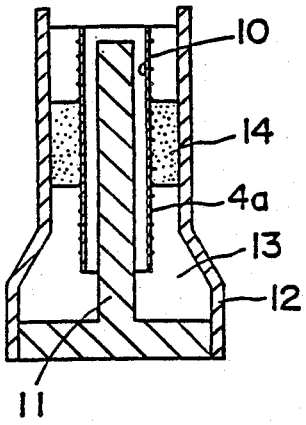
Figure 3C:
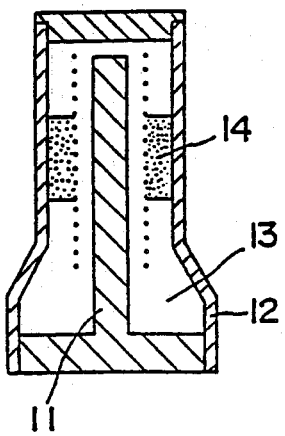

A net (4*a*) with an opening of 7 mm made of natural fibers 0.3 mm in diameter was placed on a guide cylinder (10) to keep the net cylindrical (FIG. 3*a*). The guide cylinder (10) was fitted to a core rod (11) to form the pouring hole, by the aid of a support (not shown) to keep concentricity. The core rod was previously provided with a rubber mold (12) to form the nozzle proper. The space within the rubber mold was filled with alumina-graphite body (13) and zirconia-graphite body (14) (FIG. 3*b*). The support for the guide cylinder was removed, and the space between the core rod (11) and the guide cylinder (10) was filled with the alumina-graphite body. With the cylindrical net (4*a*) left in place, the guide cylinder (10) was removed. With the lid on for sealing, pressure molding was performed using a rubber press (FIG. 3*c*).

Figure 3D:
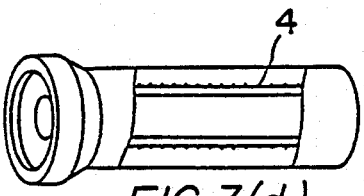
Figure 3E:
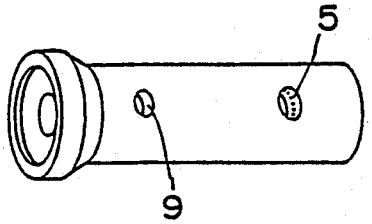

The resulting molded product was fired in a reducing atmosphere. The periphery and overall length were finished to desired dimensions (FIG. 3*d*). The hole (9) reaching the reticulate small holes was made below the flange of the nozzle. Into this hole was fitted the metal socket through which a gas is blown. The outlet (5) was drilled at a predetermined position over the reticulate small holes (FIG. 3*e*).

The immersion nozzle was evaluated by actual casting while blowing an inert gas through the upper hole. It permitted the casting of 1050 tons of molten metal without any trouble, whereas the conventional immersion nozzle became unusable after the casting of 900 tons due to the clogging of the outlet.

EXAMPLE 3

Figure 4A:
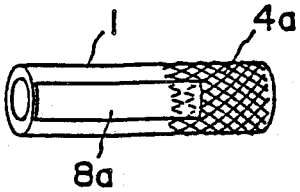
Figure 4B:
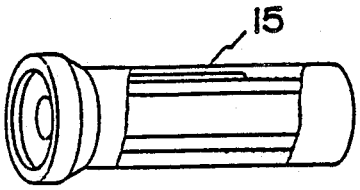

An immersion nozzle of this invention was produced according to the steps as shown in FIG. 4. The inner cylinder (1) was previously prepared from alumina-graphite. A portion of the inner cylinder (1) was covered with the cylindrical net (4*a*) with an opening of 6 mm made of polyethylene filaments 0.3 mm in diameter. The wax (8*a*) was applied in a narrow strip form (30 mm wide and 1 mm thick), with one end overlapping with the net (4*a*) and the other end extending to the lower part of the flange. In this way there was formed the passage (15) through which a gas is introduced to the net (4*a*) (FIG. 4*b*). The cylindrical body was fitted to the core to form the pouring hole. The cylindrical body was covered with a rubber mold to form the nozzle proper. The space was filled with an alumina-graphite body to form the nozzle proper and a zirconia-graphite body to form the protective layer. With the mold sealed by a lid, pressure molding was performed by means of a rubber press to form the nozzle proper.

Figure 4C:
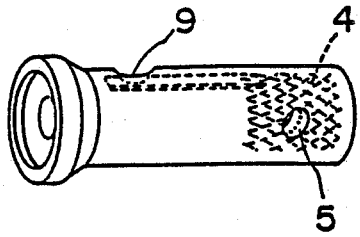

The molded nozzle proper was fired with reduction in coke and the periphery and overall length of the nozzle were finished to desired dimensions (FIG. 4*b*). The outlets (5) were made by drilling through the reticulate small holes, and the small hole (9) was made which communicates with the gas passage (15) formed by the wax (FIG. 4*c*). Into the hole (9) was fitted the metal socket (6) for the connection of a gas blowing tube. Thus there was obtained the immersion nozzle. The immersion nozzle permitted the continuous casting of blooms up to 180 tons without any trouble, whereas the conventional one became unusable after the casting of 120 tons due to the clogging of the outlet.

EXAMPLE 4

Figure 5A:
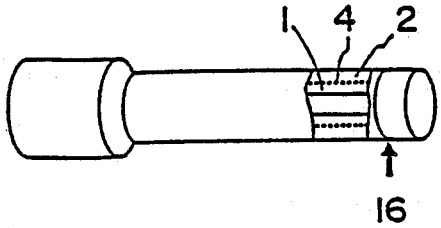
Figure 5B:
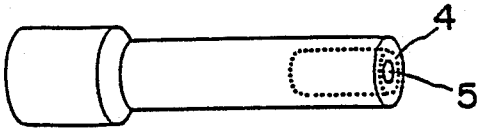

Although the immersion nozzles in the above-mentioned examples 1 to 3 have the outlet formed in the direction perpendicular to the axis of the nozzle, the outlet can be prepared as an example of this invention by extending the pouring hole as shown in FIG. 5. This cylindrical immersion nozzle is made up of the inner wall (1) forming the pouring hole, the reticulate small holes (4), and the outer wall (2) placed one over another, with the end (16) cut to form the outlet (5) surrounded by the reticulate small holes (4).

According to this invention, the reticulate small holes are produced by using a reticulate material which carbonizes, evaporates, or shrinks to form voids when the nozzle proper is fired. Examples of the reticulate material include natural fibers, organic fibers, and filaments of polyethylene, PVA, polyvinyl chloride, phenolic resin, and furan resin. The reticulate material is formed by weaving or knitting the fibers or filaments. The reticulate material may be used in the form of multiple layers.

The hollow chamber in the immersion nozzle may be formed by using organic fibers such as paper board, cloth, and Japanese paper in the form of a cylinder or plate, or an organic substance such as wax, rubber, acrylic resin, polyethylene, polyvinyl chloride, and styrene in the form of a cylinder or plate. The organic fiber or organic substance may be applied to or wound around a previously formed cylinder of gas permeable substance or nozzle-forming material. It may be also possible to form a slit corresponding to the hollow chamber by carrying out the treatment such as firing and heating for the small hole-forming material covering the inner wall.

In the above-mentioned examples the immersion nozzles were prepared by firing. However, the invention may be applied to those which are not to be fired. In such a case, the organic filaments are made into breathable holes by heat treatment at a low temperature.

Figure 6:
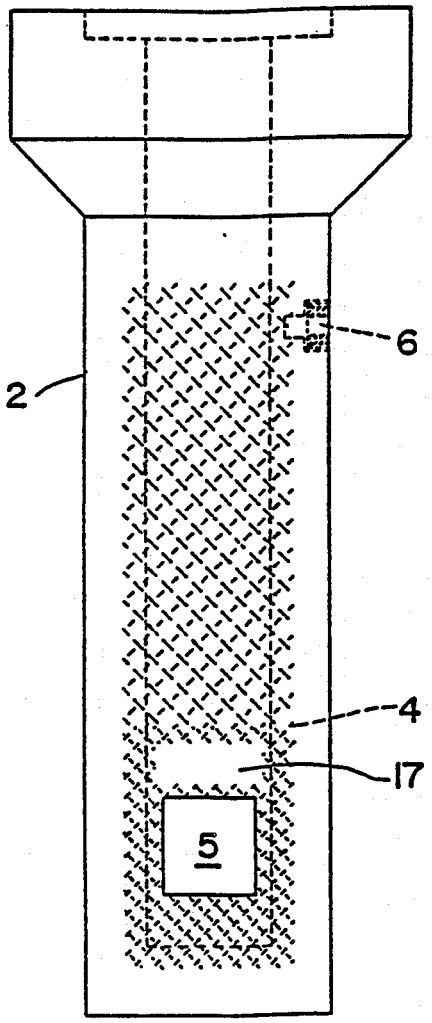
FIG. 6 is a sectional view of another embodiment of the casing nozzle or this invention.

In the above-mentioned examples the immersion nozzles merely have the reticulate small holes (4). However, the immersion nozzle may have a means to control the distribution of the gas passing through the reticulate small holes (4). For example, the immersion nozzle as shown in FIG. 6 has a notch (17) near the upper part of the outlet (5). The notch (17) cuts off the gas passage and prevents the gas from blowing out of the upper part of the outlet (5). In order to completely eliminate the gas blowing from the upper part, the reticulate material should have a notch formed across the outlet. In this way it is possible to form the gas blowout holes at any places. The place and flow rate of the gas blowout may be adjusted by arranging a coarse reticulate material at the upper part of the outlet (5) and fine reticulate organic filaments at the lower part of the outlet (5), or by arranging thin organic filaments at the upper part of the outlet and thick organic filaments at the lower part of the outlet. In this way it is possible to permit the gas to blow out uniformly from the periphery of the outlet or control the gas blowing as desired. This makes it possible to obtain a desired state without harm even when there is a difference in the pressure of molten metal.

As mentioned above, the casting nozzle of this invention has the outlet on which there are openings of small holes reticulately connected to one another extending from the hollow chamber for gas blowing. Therefore, the outlet is not clogged with nonmetallic impurities such as alumina. The reticulately connected small holes are easily formed by the carbonization, evaporation, or shrinkage of organic filaments at the time of heating.

What is claimed is:

1. A process for making a casting nozzle comprising the steps of:

applying reticulate filaments of an organic material around a preformed inner cylindrical body provided with a pouring hole therein;

forming an outer cylindrical body on said inner cylindrical body surrounded by said reticulate filaments;

firing the formed body to form a gas-permeable reticulate hole within the fired body by carbonizing and evaporating said organic material; and cutting said fired body through said gas-permeable reticulate hole to form an outlet and having openings of said gas-permeable reticulate hole formed therein.

2. A process according to claim 1, wherein said cutting of said fired body is effected by drilling.

3. A process according to claim 1, comprising applying said reticulate filaments to said inner cylindrical body in multiple layers.

4. A process according to claim 1, wherein said reticulate filaments comprise shrunk organic fibers.

5. A process according to claim 4, wherein said shrunk organic fibers comprise a cylindrical net of shrunk polyethylene fibers.

6. A process according to claim 1, wherein said reticulate filaments are selected from the group consisting of natural fibers, polyethylene, polyvinyl-acetate, polyvinyl chloride, phenolic resin and furan resin.

7. A process according to claim 1, wherein said reticulate filaments are woven.

8. A process according to claim 1, wherein said reticulate filaments are knitted.

9. A process according to claim 1, wherein said reticulate filaments comprise a first portion of relatively coarse reticulate material and a second portion of relatively fine reticulate material.

10. A process according to claim 1, wherein said reticulate filaments comprise a first portion of relatively thin organic filaments and a second portion of relatively thick organic filaments.

11. A process according to claim 1, further comprising forming a protective layer on said outer cylindrical body at a position corresponding to a slag level.

12. A process according to claim 11, wherein said protective layer is a zirconia-graphite body.

13. A process according to claim 1, further comprising applying a layer of wax around said preformed cylindrical body before forming said outer cylindrical body, said layer of wax partially overlapping said reticulate filaments, whereby said wax evaporates during firing to form a hollow chamber communicating with said reticulate hole.

14. A process according to claim 13, further comprising cutting said fired body to form an inlet communicating with said hollow chamber, whereby gas can be blown through said inlet, hollow chamber and reticulate hole to the outlet of said fired body.

15. A process according to claim 14, wherein said cutting of said fixed body to form said inlet is effected by drilling.

16. A process according to claim 1, comprising forming said outer cylindrical body by press molding.

17. A process for making a casting nozzle comprising the steps of:

applying reticulate filaments of an organic material around a preformed inner cylindrical body provided with a pouring hole therein;

forming an outer cylindrical body on said inner cylindrical body surrounded by said reticulate filaments;

firing the formed body to form a gas-permeable reticulate hole within the fired body by carbonizing and evaporating said organic material; and cutting an outlet in said fired body such that said outlet extends to said gas-permeable reticulate hole, whereby during use of the finished casting nozzle, gas is blown out through said gas-permeable reticulate hole to said outlet to prevent clogging of said outlet.

* * * * *